US010300366B2

(12) United States Patent
Di Dio

(10) Patent No.: US 10,300,366 B2
(45) Date of Patent: May 28, 2019

(54) BOWLING PIN SETTING DEVICE

(71) Applicant: GEMAC SRL, Poviglio (RE) (IT)

(72) Inventor: Mario Giovanni Di Dio, Castelnovo di Sotto (IT)

(73) Assignee: GEMAC SRL, Poviglio (RE) (IT)

( * ) Notice: Subject to any disclaimer, the term of this patent is extended or adjusted under 35 U.S.C. 154(b) by 0 days.

(21) Appl. No.: 15/824,764

(22) Filed: Nov. 28, 2017

(65) Prior Publication Data

US 2018/0147479 A1 May 31, 2018

(30) Foreign Application Priority Data

Nov. 29, 2016 (IT) ..... 102016000120570

(51) Int. Cl.
*A63D 5/08* (2006.01)

(52) U.S. Cl.
CPC ..... *A63D 5/08* (2013.01); *A63B 2243/0054* (2013.01); *A63D 2005/083* (2013.01)

(58) Field of Classification Search
CPC ..... A63D 5/08; A63D 5/09; A63D 2005/083
USPC ..... 473/78
See application file for complete search history.

(56) References Cited

U.S. PATENT DOCUMENTS

| | | | | |
|---|---|---|---|---|
| 3,458,191 A | | 7/1969 | Murdoch et al. | |
| 4,376,534 A | * | 3/1983 | Schmid | A63D 5/08 242/147 R |
| 5,167,412 A | * | 12/1992 | Rochefort | A63D 5/08 473/78 |
| 9,180,360 B2 | * | 11/2015 | De Lange | A63D 5/08 |

FOREIGN PATENT DOCUMENTS

| | | | |
|---|---|---|---|
| CN | 2817926 | Y | 9/2006 |
| DE | 2629552 | A1 | 1/1977 |
| WO | 2015140142 | A1 | 9/2015 |

OTHER PUBLICATIONS

Extended European Search Report and Written Opinion dated Jun. 15, 2018, for corresponding European application EP 17 203 730.1.

* cited by examiner

*Primary Examiner* — Melba Bumgarner
*Assistant Examiner* — Laura Davison
(74) *Attorney, Agent, or Firm* — Volpe and Koenig, P.C.

(57) ABSTRACT

A positioning system for bowling pins includes: a support frame; levers, each independently rotatably associated to the frame, according to an oscillating axis oscillating between rest and perturbed positions; cables, each having first and second ends, fixed to a respective lever; a carriage slidably associated to the support frame; first guides connected to the carriage, each configured to contact a respective cable between the respective lever and pin; a positioning template, provided with accommodating openings of the pins, in which a portion of a corresponding cable is inserted; brakes, each connected to the support frame, associated to a respective cable and actuatable between a blocking position and an unblocking position; an electric motor to actuate the carriage between first and second positions; sensors, each of which is associated to a corresponding lever and is configured the lever position; a control, which detects lever positions and manages the motor and brakes.

7 Claims, 4 Drawing Sheets

BOWLING PIN SETTING DEVICE

TECHNICAL FIELD

The present invention relates to a device for positioning and/or repositioning bowling pins and, more specifically, a device for positioning and/or repositioning bowling pins in which each pin is connected to a respective cable.

PRIOR ART

Bowling lanes are known, in which pins are fastened by means of cables to a positioning device whose task is to array the pins on the lane, in the regulation equilateral triangle arrangement, after each throw of the bowling ball.

When the ball is thrown, the positioning device is configured not to act on the cable, so that the pins hit by the ball can be knocked down.

Subsequently, the positioning device pulls the cables, dragging the pins to enter the openings of a positioning template, adapted to distance the pins and arrange them according to the triangle arrangement.

After this operation, the cables are gradually released, setting the pins on the lane.

When the pins are knocked down and/or when they are subsequently dragged towards the positioning template, it can occur that some of the cables become entangled with each other, with the consequence that it becomes impossible to drag the pins into the openings of the positioning template and hence to arranged in an orderly manner on the lane.

To overcome this drawback, solutions are currently known which make it possible to determine when the cables are entangled and, in this case, to command the positioning device to lift and release all pins in a programmed manner until the cables are disentangled.

However, these prior art solutions do not allow to exactly identify which cables are entangled, so that the lifting and releasing procedure is carried out for all pins, including those connected to the cables that are not entangled, the procedure thus being relatively long and needlessly costly from the standpoint of energy.

An object of the present invention is to provide a device for positioning the pins that is able to disentangle the cables in a shorter time and hence that makes it possible to consume less energy than prior art devices, within the scope of a solution that is simple and rational and has low cost.

These purposes are achieved by the features of the invention set forth in the independent claim. The dependent claims outline preferred and/or particularly advantageous aspects of the invention.

SUMMARY

The invention provides a positioning system for bowling pins comprising:

a support frame, a plurality of levers, each of which is rotatably associated to the support frame, independently of one another according to an oscillating axis, in order to be able to oscillate between a rest position and a perturbed position, a plurality of cables, each comprising a first end fixed to a respective pin and a second end, fixed to a respective lever, a carriage slidably associated to the support frame, a plurality of first guides connected to the carriage, each configured for contacting a portion of a respective cable comprised between the respective lever and the respective pin, a positioning template, which is provided with a plurality of accommodating openings of the pins, internally of each of which a portion of a corresponding cable is slidably inserted, a plurality of brakes, each of which is connected to the support frame, is associated to a respective cable and is actuatable between a blocking position, in which it retains the cable, and an unblocking position, in which it frees the cable, an electric motor configured for activating the carriage between a first position, wherein the distance between the carriage and the plurality of levers is maximum, and a second position, wherein the distance between the carriage and the plurality of levers is minimum, a plurality of sensors, each of which is associated to a corresponding lever and is configured for detecting the position of such lever, and a control unit able to detect, via the plurality of sensors, the position of the plurality of levers and to manage the electric motor and the plurality of brakes.

Thanks to this solution, when some cables are mutually entangled, it is possible exactly to identified which ones are entangled and to intervene specifically only on them, thus limiting the number of operations necessary to restore the order of the pins, thereby reducing the time and electricity consumption necessary to complete these operations.

According to an aspect of the invention, each sensor can comprise a photocell.

In this way, the operation of identifying the entangled cables can be carried out by means of a device that is reliable and has low cost and small dimensions.

According to another aspect of the invention, the control unit can be configured in such a way as:

to monitor the electrical absorption of the motor while the carriage moves from the second position to the first position, to monitor, via the sensors, the position of the levers, when the electrical absorption of the electric motor exceeds a predetermined threshold, to activate into a blocking position the brakes of the cables whose levers are in a rest position, to activate the electric motor for moving the carriage between the first position and the second position up to when the carriage reaches the first position and all the sensors detect that the levers are in the rest position.

Thanks to this control logic of the positioning system, the operations necessary to disentangle the entangled cables are minimised and hence the time and the energy consumption necessary to carry them out are reduced.

In addition, going to preventively monitor the energy absorption of the electric motor, it is advantageously possible to use the position sensors only when the cables are actually entangled, saving energy in the other cases.

According to a further aspect of the invention, the system can comprise a plurality of second guides, which are fixed to the support frame in proximity to the plurality of levers and are in contact with a portion of a respective cable comprised between the first guide and the first end.

In this way, a displacement of the carriage by one unit of length corresponds to a change in length of the portion of cable located between the second guide and the pin substantially equal to two units of length, thus making it possible to build a more compact machine for equal length of the cable and able to carry out the pin positioning operations in a shorter time at equal carriage speed.

According to a further aspect of the invention, the positioning device can comprise a plurality of third guides, which are fixed to the support frame in proximity to the template and are in contact with a portion of a respective cable located between the first guide and the first end.

In this way it is possible to guide each segment of cable inserted in the respective opening of the positioning template, for example in such a way that said segment is substantially perpendicular to the plane of the bowling lane, thus allowing precise positioning of the pins, and thereby reducing the wear of the cable due to rubbing with the edges of the openings.

According to a further aspect of the invention, the control unit and the electric motor can operate at low voltage.

In this way, the positioning device is safer and makes it possible to consume less energy.

Advantageously, the carriage can be configured to slide along an orthogonal direction to the oscillating axis of the levers.

Thanks to this solution, the activation of the cables is more efficient and the positioning device can be kept particularly compact.

According to an additional aspect of the invention, the positioning system can comprise a transmission able to connect the motor to the carriage, which has a flexible member loop-wound and stretched between an output shaft of the motor and an idle wheel, and wherein the carriage is connected to a portion of the flexible member comprised between the output shaft and the idle wheel.

In this way, a simple, reliable system for actuating the carriage is provided.

BRIEF DESCRIPTION OF THE DRAWINGS

Further features and advantages of the invention shall become readily apparent from reading the following description provided by way of non-limiting indication, with the aid of the figures illustrated in the accompanying drawings.

DETAILED DESCRIPTION

Figure 1:
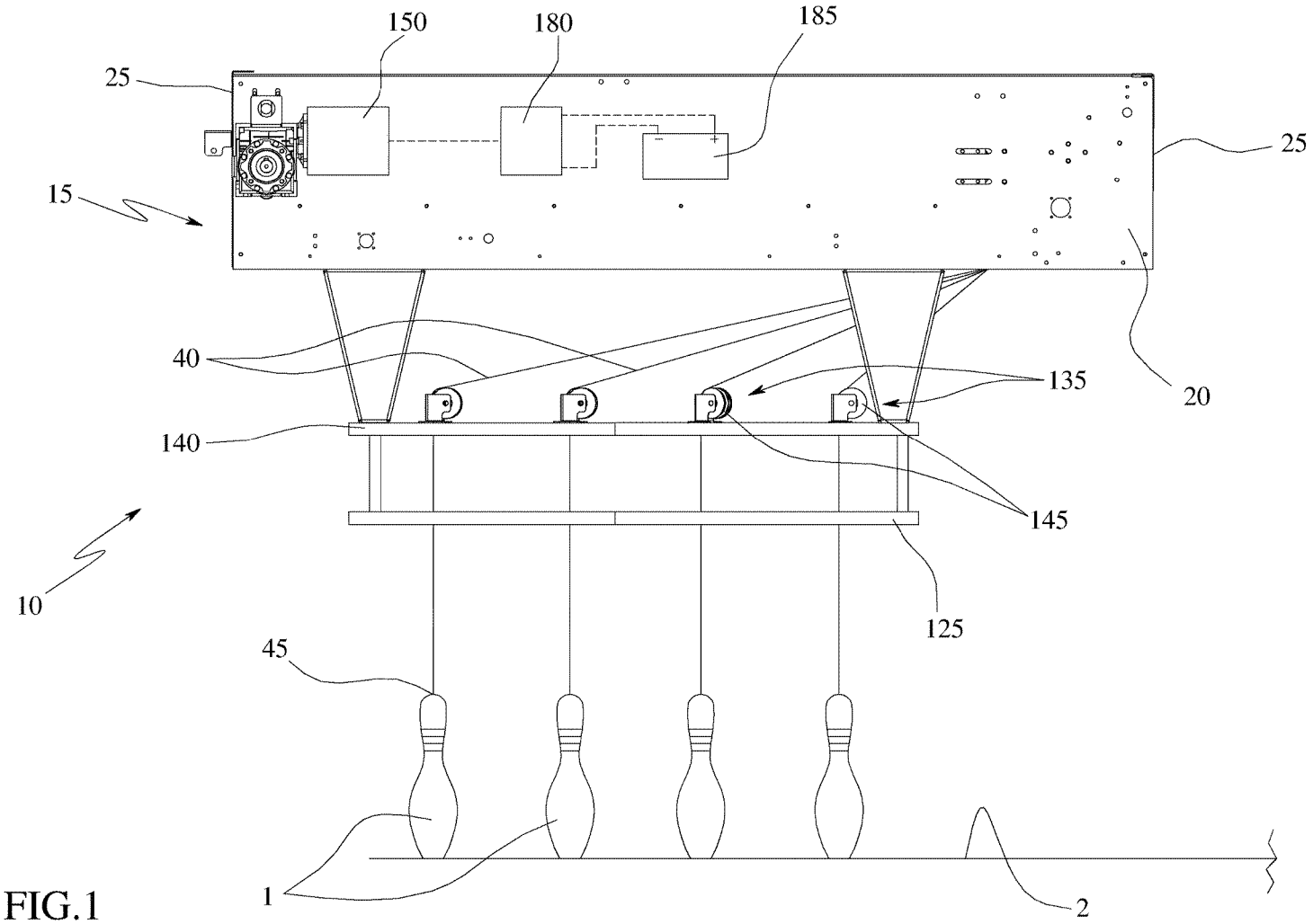
FIG. 1 is a side view of the positioning device according to the invention, shown in an operating condition.

With particular reference to the figures, the numeral 10 globally indicates a device for positioning pins 1 on a bowling lane 2.

The positioning device 10 is provided with support frame 15, which comprises a pair of lateral sides 20, having longitudinal axes that are substantially parallel to each other, and a pair of uprights 25, parallel to each other and adapted to connect the ends of a lateral side 20 with the corresponding ends of the other lateral side 20.

The support frame 15 is positioned above the bowling lane 2, at a distance therefrom that is always greater than the height of a pin 1 positioned vertically, and in such a way that the longitudinal axes of the lateral sides 20 lie on a plane that is substantially parallel to a plane of lay of the lane 2.

The support frame 15 can for example be sustained in position by means of a structure made of metal or masonry (not shown in the drawings).

Figure 2:
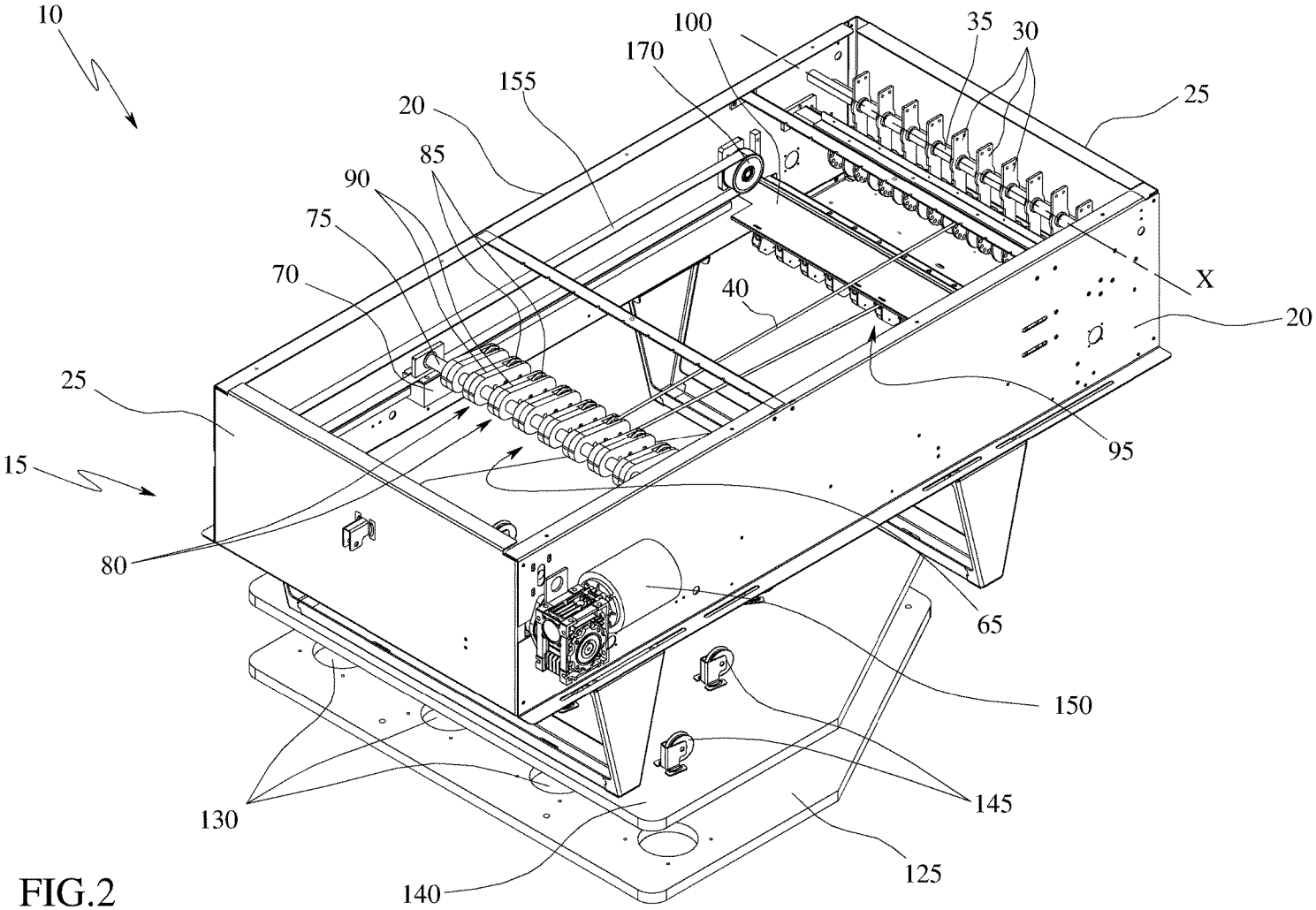
FIG. 2 is a perspective view of the positioning device according to the invention.
Figure 3:
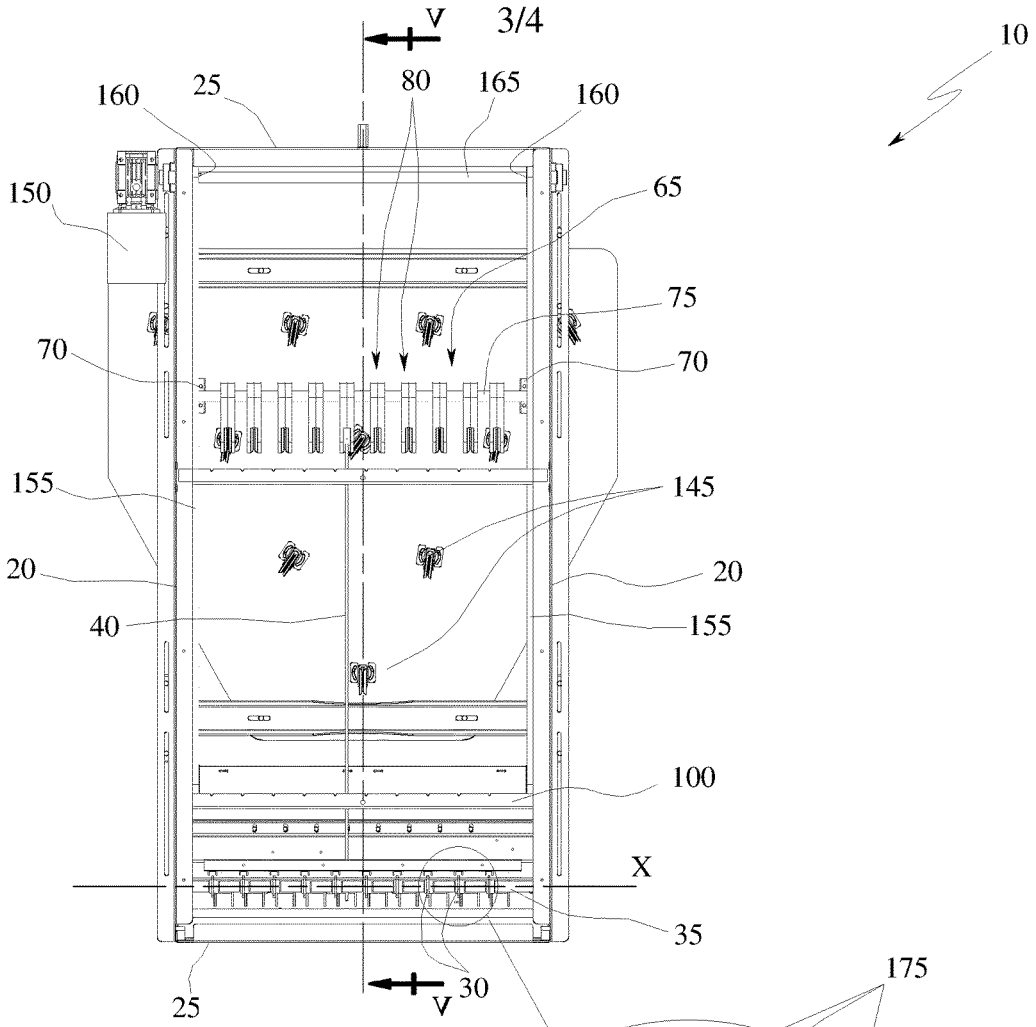
FIG. 3 is a top view of FIG. 2.

As shown in FIG. 2, the positioning device 10 comprises a plurality of reference elements, for example a plurality of levers 30, which are rotatably associated to the support frame 15 independently from each other and according to an oscillating axis X substantially perpendicular to the longitudinal axes of the lateral sides 20.

For example, the positioning device 10 has a number of levers 30 equal to the number of pins 1 positioned in the bowling lane.

Each lever 30 oscillates relative to the oscillating axis X between a rest position and a perturbed position.

Figure 5:
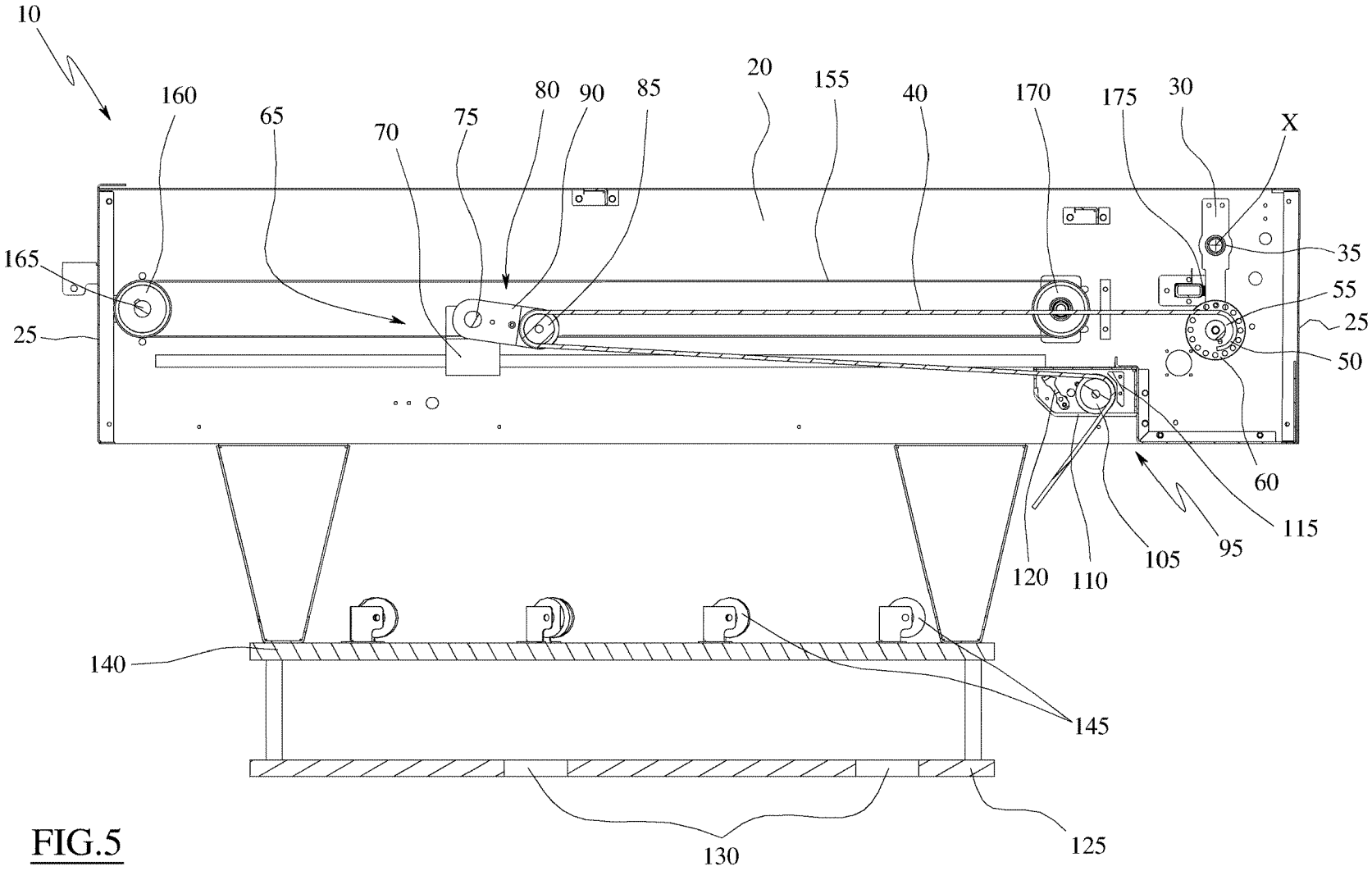
FIG. 5 is a section view according to the plane V-V of FIG. 4.

With particular reference to FIG. 5, each lever 30 can for example comprise an elongated flat plate, lying on a plane that is perpendicular to the oscillating axis X (i.e. lying on a plane on which the oscillation of the lever 30 is contained).

For example, the plurality of levers 30 is associated to the support frame 15 by means of a single connecting rod 35, interposed between the lateral sides 20 and positioned with its longitudinal axis substantially coinciding with the oscillating axis X.

The connecting rod 35 is preferably positioned in proximity to an upright 25.

Each lever 30 has a through hole, positioned between an upper end of the lever 30 and half of the longitudinal length of the lever itself, within which the connecting rod 35 is inserted with play.

In this way, the force of weight maintains each lever 30, when not perturbed, in vertical position, i.e. with its longitudinal axis substantially perpendicular to the lane 2.

The positioning device 10 comprises a plurality of cables 40, each provided with a first end 45 fixed to the head of a respective pin 1 and a second end 50 (see FIG. 5) fixed to a lower end of the respective lever 30.

For example, each second end 50 is fixed to the respective lever 30 by means of the interposition of a cylindrical body 55 fixed and/or rotatably associated to the lower end of the lever and on which said second end 50 of the cable 40 is partially wound.

The cylindrical body 55 has its central axis substantially parallel to the oscillating axis X.

A disk 60 provided with a plurality of holes drilled in the peripheral portion of the disk itself is fixed to each cylindrical body 55.

The positioning device 10 comprises a carriage 65 slidably associated to the support frame 15 according to a direction orthogonal to the oscillating axis X, for example parallel to the longitudinal axes of the lateral sides 20, i.e. horizontal.

For example, the carriage 65 comprises a pair of slides 70, each of which is slidably associated to a respective lateral side 20 and is positioned with the longitudinal axis substantially parallel to the longitudinal axis of the lateral side 20.

The carriage 65 further comprises a bridge 75, which is positioned with its longitudinal axis substantially parallel to the oscillating axis X.

In the embodiment shown in the figures, the slides 70 are connected via the bridge 75.

The bridge 75 can for example comprise a bar (with circular cross section) whose ends are fixed to the slides 70.

The positioning device 10 is provided with a plurality of first guides 80, for example one for each cable 40, each of which is configured to contact a portion of a respective cable 40 positioned between the first end 45 and the second end 50.

Each first guide 80 is associated to the bridge 75 independently to the other first guides 80.

Each first guide 80 comprises an idle pulley 85, on which is partially wound a portion of the respective cable 40 positioned between the first end 45 and the second end 50.

Each first guide 80 can also comprise a connecting body 90, which at one end is rotatably associated to the bridge 75 with respect to an axis substantially parallel to the longitudinal axis of the bridge 75 and at the opposite end supports the idle pulley 85 of the respective first guide 80.

The positioning device 10 also comprises a plurality of second guides 95, one for each cable 40, which are fixed to the support frame 15 in proximity to the plurality of levers 30, for example at a lower height than the lower end of said levers 30 (see FIG. 5).

Advantageously, said second guides 95 are fixed to the support frame 15 by means of a connecting bar 100 having longitudinal axis substantially parallel to the oscillating axis X and whose ends are fastened to the lateral sides 20.

Each second guide 95 comprises a second idle pulley 105, having axis of rotation substantially parallel to the oscillating axis X, on which is partially wound a portion of the respective cable 40 positioned between said second idle pulley 105 and the first end 45.

Each second guide 95 also comprises a box-shaped body 110, provided with a first opening and a second opening traversed by the same cable 40, and within which the respective idle pulley 105 is positioned.

Moreover, each second guide 95 comprises an edge element 115, adapted to encompass a portion of the respective idle pulley 105 so as to prevent the cable 40 from deviating from said idle pulley 105.

The positioning device 10 comprises a plurality of brakes 120, each of which is associated to a respective cable 40 and is actuatable between a blocking position, in which it retains the cable, and an unblocking position, in which it frees the cable 40.

Each brake 120 is positioned along a segment of cable 40 located between the corresponding first guide 80 and the corresponding second guide 95, for example each brake 120 can be located within the box-shaped body 110 of the respective second guide 95.

Each brake 120 comprises a sliding block, fixed to the end of a rod adapted to rotate relative to a fulcrum, so that said sliding block presses the respective cable 40 against the support frame 15, for example against a portion of the box-shaped body 110 of the respective second guide 95.

The positioning device 10 comprises a template 125 for positioning the pins 1 adapted to distance the pins 1 and array them according to a regulation equilateral triangle arrangement.

This arrangement is known to the person skilled in the art and therefore it is not further described herein.

The positioning template 125 is fixed to the support frame 15, for example it is positioned at an intermediate height between the support frame 15 and the head of the pins 1, and it is provided with a plurality of openings 130 for accommodating the pins 1, which are positioned relative to each other so as to array the pins 1 according to the regulation equilateral triangle arrangement.

The positioning template 125 can be embodied as a flat and relatively thin plate which lies parallel to the bowling lane 2, normally horizontal.

The accommodating openings 130 have a central axis that is substantially perpendicular to the plane of lay of the lane 2, i.e. substantially perpendicular to the plane on which lie the longitudinal axes of the lateral sides 20, and can for example have circular shape.

The positioning device 10 comprises a plurality of third guides 135 (see FIG. 1), one for each cable 40, which are fastened to the support frame 15 above the positioning template 125 at the accommodating openings 130, for example at a lower height relative to the height of the second guides 95.

The third guides 135 are in contact with a portion of a respective cable 40 positioned between the respective second guide 95 and the first end 45 of said cable 40.

In particular, the third guides 135 are positioned so that, when the pins 1 are raised from the lane 2, the portion of the respective cable 40 positioned between said third guide 135 and the first end 45 is substantially parallel to the central axis of the corresponding accommodating opening 130.

Preferably, the third guides 135 are positioned so that, when the pins 1 are raised from the lane 2, the portion of the respective cable 40 positioned between said third guide 135 and the first end 45 is substantially coaxial to the central axis of the corresponding accommodating opening 130.

The third guides 135 can be supported by a flat plate 140, lying on a plane parallel to the positioning template 125 and positioned at a greater height than the template 125.

The flat plate 140 can comprise a plurality of through holes, each of which is vertically aligned with a respective opening 130 of the positioning template, so as to be able to receive a portion of the respective cable 40.

Each third guide 135 can be associated to a respective hole of the flat plate 140 and can comprise a pulley 145 on which is partially wound a portion of a respective cable 40 positioned between the second idle pulley 105 and the corresponding through hole (i.e. the third pulleys 145 are fixed superiorly to the flat plate 140).

The positioning device is activated by means of an electric motor 150 configured for actuating the carriage 65 between a first position, wherein the distance between the carriage 65 and the plurality of levers 30 is maximum, and a second position, wherein the distance between the carriage 65 and the plurality of levers 30 is minimum.

In the first position, the length of the portion of each cable 40 located between the respective second guide 95 and the respective first end 45 is minimum and the pins 1 are inside the accommodating openings 130 of the positioning template 125; in the second position, the length of the portion of each cable 40 located between the respective second guide 95 and the respective first end 45 is potentially maximum and the pins 1 bear on the bowling lane 2.

In the embodiment shown in the drawings, the electric motor 150 is adapted to actuate both the slides 70 of the carriage 65 between the first position and the second position.

The electric motor 150 is powered at low voltage, for example 24V, and with alternating current.

Preferably, the electric motor 150 can be of the brushless type with alternating current with Hall cell reading board.

The electric motor 150 is connected to the carriage 65 by means of a transmission, which is provided with a flexible member 155 loop-wound and stretched between a driving pulley 160 spliced on an output shaft 165 of the electric motor 150 and an idle wheel 170 rotatably associated to a lateral side 20 of the support frame 15.

In particular, the carriage 65 is fixed to a portion of the flexible member 155 located between the driving pulley 160 and the idle wheel 170.

For example, the transmission comprises a pair of flexible members 155, each connected to a corresponding slide 70 and stretched between a respective driving pulley 160 and a respective idle wheel 170.

The flexible member 155 can for example be a belt or a chain.

In the embodiment shown in the figures, there is a reduction gear between the motor 115 and the driving pulley 160.

Figure 4:
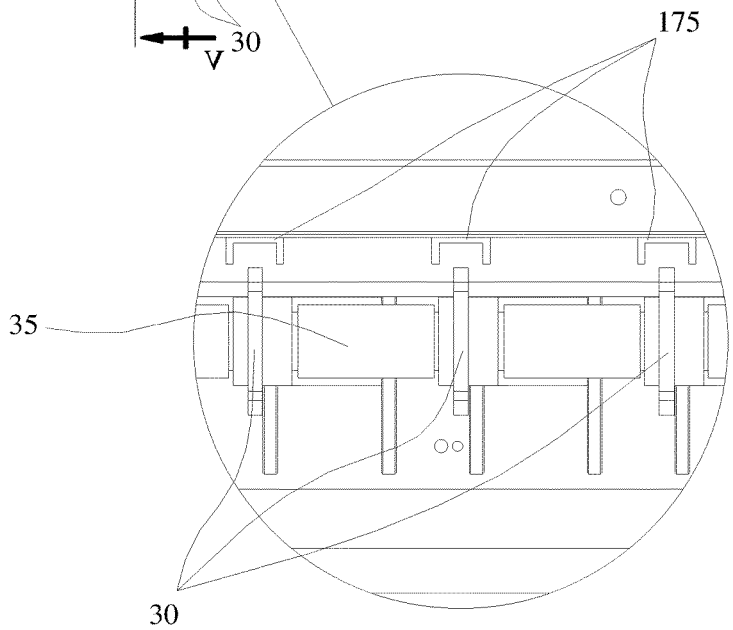
FIG. 4 is an enlargement of a portion of FIG. 3.

As shown in FIGS. 4 and 5, the positioning device 10 comprises a plurality of sensors 175, each of which is associated to a corresponding lever 30 and is configured to sense the position of the lever 30, i.e. whether the lever 30 is in a rest position or perturbed position.

Each sensor 175 comprises a photocell, which is provided with an emitter portion and a receiver portion facing each other, and is fixed to the support frame 15 so that when the corresponding lever 30 is in the perturbed position, a portion of said lever 30 located between the through hole into which the connecting rod 35 is inserted and the lower end of the lever 30 is interposed between the receiver portion and the emitter portion of the photocell.

For example, the photocell can be of the fork type with single body.

The positioning device 10 lastly comprises a control unit 180 (see FIG. 1), which is configured to receive an input signal coming from each sensor 175 and containing the information about the position of the respective lever 30, and to manage the electric motor 150 and the plurality of brakes 120.

The control unit is powered at low voltage, for example 24V, via a direct current electric source, for example a battery 185 or an AC-DC transformer.

The operation of the positioning device 10 according to the invention is as follows.

Before the bowling ball is thrown against the pins 1, the carriage 65 is brought to the second position, so that the pins 1 are set down on the bowling lane 2 and the portion of cable 40 located between the second guide 95 and the first end 45 of the cable is potentially longest.

Depending on the force of the impact, the ball knocks the pins 1 or removes them from the original position; consequently, the pins 1 that are hit pull the cable 40 to which they are fixed.

At this point, the pins 1 are recovered and ordered according to the regulation equilateral triangle arrangement.

The control unit 180 activates the electric motor 150 which through the transmission moves the carriage 65 from the second position to the first position.

During this move of the carriage 65, the pins 1 are dragged towards the positioning template 125 and enter the accommodating opening 130, thanks to which they are ordered in the equilateral triangle arrangement.

If, during this operation, the cables of the pins 1 do not become entangled, all the pins 1 enter the accommodating openings 130 in vertical position and subsequently the control unit 180 activates the electric motor to move the carriage to the second position, thus setting the pins 1 down in vertical position on the lane 2.

If instead the cables 40 of some pins become entangled, the pins 1 cannot enter the accommodating openings 130 and the control unit 180 detects that in the passage of the carriage 65 from the second position to the first position the electric energy absorbed by the electric motor increases.

Moreover, the levers 30 associated to the entangled cables 40 rotate, clockwise with respect to FIG. 5, from the rest position (shown in the figure) to the perturbed position (not shown).

Therefore, if the electric power absorbed by the electric motor 150 exceeds the predetermined threshold, the control unit 180 by means of the sensors verifies the position of the levers 30; if levers 30 in perturbed position are present, said control unit 180 stops the electric motor 150 and activates in blocking position the brakes 120 corresponding to the cables 40 whose respective levers 30 are in rest position.

Subsequently the control unit 180 repeatedly activates the electric motor 150 so that the carriage 65 goes forwards and backwards several times from the second position towards the first position until the time when the absorption of electrical energy remains below the predetermined thresholds and it does not sense the presence of levers 30 in perturbed position.

These upwards and downwards movements of the pins 1 autonomously bring the entangled cables 40 to disentangle.

Once no cable 40 is entangled anymore, all the pins 1 enter the accommodating openings 130 in vertical position and subsequently the control unit 180 activates the electric motor 150 to move the carriage to the second position, setting the pins 1 down in vertical position on the lane 2.

The invention thus conceived is susceptible to many modifications and variants, all falling within the same inventive concept.

Furthermore, all details may be replaced by technically equivalent elements.

In practice, the materials used, as well as their shapes and dimensions, can be of any type according to the technical requirements without thereby departing from the scope of protection of the following claims.

The invention claimed is:

1. A positioning system (10) for bowling pins (1) comprising:

a support frame (15), a plurality of levers (30), each of which is rotatably associated to the support frame (15), independently of one another according to an oscillating axis (X), in order to be able to oscillate between a rest position and a perturbed position, a plurality of cables (40), each comprising a first end (45) fixed to a respective pin (1) and a second end (50) fixed to a respective lever (30), wherein the respective lever is rotated to the perturbed position when the respective cable becomes entangled, a carriage (65) slidably associated to the support frame (15), a plurality of first guides (80) connected to the carriage (65), each configured for contacting a portion of a respective cable (40) comprised between the respective lever (30) and the respective pin (1), a positioning template (125), which is provided with a plurality of accommodating openings (130) for the pins (1), internally of each accommodating opening (130) a portion of a corresponding cable (40) being slidably inserted, a plurality of brakes (120), each of which is connected to the support frame (15), is associated to a respective cable (40) and is actuatable between a blocking position, in which the brake (120) retains the cable (40), and an unblocking position, in which the brake frees the cable (40), an electric motor (150) configured for activating the carriage (65) between a first position, wherein a distance between the carriage (65) and the plurality of levers (30) is maximum, and a second position, wherein a distance between the carriage (65) and the plurality of levers (30) is minimum, a plurality of sensors (175), each of which is associated to a corresponding lever (30) and is configured for detecting the position of the lever (30), a control unit (180) able to detect, via the plurality of sensors (175), the position of the plurality of levers (30) and to manage the electric motor (150) and the plurality of brakes (120), wherein the control unit (180) is configured to:

activate the electric motor (150) to move the carriage (65) from the second position to the first position to raise the pins toward the positioning template, monitor the electrical absorption of the electric motor (150) during said movement of the carriage (65), identify, via the sensors (175), the position of the levers (30), if the monitored electrical absorption of the electric motor (150) exceeds a predetermined threshold to identify which cables have become entangled, activate into the blocking position the brakes (120) associated to the cables (40) fixed to the levers (30) that have been identified to be in the rest position, and, while keeping the activated brakes (120) in the blocking position, activate the electric motor (150) for moving the carriage (65) between the first position and the second position to raise and lower the pins fixed to the entangled cables until the carriage (65) reaches the first position and all the sensors (175) detect that the levers (30) are in the rest position.

2. The positioning system (10) of claim 1, wherein each sensor (175) comprises a photocell.

3. The positioning system (10) of claim 1, further comprising a plurality of second guides (95) fixed to the support frame (15) in proximity of the plurality of levers (30), said second guides (95) each being in contact with a portion of a respective cable (40) comprised between the first guide (80) and the first end (45).

4. The positioning system (10) of claim 3, further comprising a plurality of third guides (135) fixed to the support frame (15) in proximity of the positioning template (125), said third guides (135) each being in contact with a portion of a respective cable (40) comprised between the second guide (95) and the first end (45).

5. The positioning system (10) of claim 1, wherein the control unit (180) and the electric motor (150) operate at low voltage.

6. The positioning system (10) of claim 1, wherein the carriage (65) is configured for sliding along a perpendicular direction to the oscillating axis (X) of the levers (30).

7. The positioning system (10) of claim 1, further comprising a transmission configured to connect the electric motor (150) to the carriage (65), wherein the transmission has a flexible member (155) loop-wound and stretched between an output shaft of the electric motor (150) and an idle wheel (170), and wherein the carriage (65) is connected to a portion of the flexible member (155) comprised between the output shaft and the idle wheel (170).

* * * * *